US008805215B2

(12) United States Patent
Ishida

(10) Patent No.: US 8,805,215 B2
(45) Date of Patent: Aug. 12, 2014

(54) IMAGE FORMING APPARATUS WITH TONER DEGRADATION SUPPRESSION

(75) Inventor: Yusuke Ishida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 13/571,634

(22) Filed: Aug. 10, 2012

(65) Prior Publication Data

US 2013/0058664 A1 Mar. 7, 2013

(30) Foreign Application Priority Data

Sep. 1, 2011 (JP) ..... 2011-190757

(51) Int. Cl.
*G03G 15/08* (2006.01)
*G03G 15/00* (2006.01)

(52) U.S. Cl.
USPC ..... 399/29; 399/45; 399/257

(58) Field of Classification Search
USPC ..... 399/29, 45, 257
See application file for complete search history.

(56) References Cited

U.S. PATENT DOCUMENTS

| | | | | |
|---|---|---|---|---|
| 5,787,321 | A * | 7/1998 | Nishikawa et al. | 399/69 |
| 6,580,884 | B2 * | 6/2003 | Kuwabara | 399/92 |
| 6,904,260 | B2 * | 6/2005 | Behnke et al. | 399/341 |
| 7,558,502 | B2 * | 7/2009 | Kanai | 399/92 |
| 8,165,481 | B2 | 4/2012 | Iimura | |
| 2002/0085856 | A1 * | 7/2002 | Kuwabara | 399/92 |
| 2009/0060540 | A1 * | 3/2009 | Matsushita et al. | 399/45 |
| 2009/0142087 | A1 | 6/2009 | Iimura | |
| 2011/0188880 | A1 * | 8/2011 | Suzuki et al. | 399/94 |

FOREIGN PATENT DOCUMENTS

| | | | |
|---|---|---|---|
| CN | 101377638 | A | 3/2009 |
| EP | 2363755 | A1 | 9/2011 |
| JP | 5-257358 | A | 10/1993 |
| JP | 2006-337699 | A | 12/2006 |
| JP | 2009-75530 | A | 4/2009 |
| JP | 2009-265604 | A | 11/2009 |

* cited by examiner

*Primary Examiner* — G. M. Hyder
(74) *Attorney, Agent, or Firm* — Fitzpatrick, Cella, Harper & Scinto

(57) ABSTRACT

An image forming apparatus includes an image forming portion that forms an image on a first image bearing member, a transfer member that transfers the image on the first image bearing member to a second image bearing member, a power supply, a detecting portion that detects a voltage value and a current value, a velocity changing portion, an environment detecting portion, and a controller that determines a transfer voltage value in transferring an image based on a result detected at the detecting portion. An image can be formed at the plurality of velocities. The controller determines a transfer voltage value at a velocity other than the plurality of velocities based on a result detected at the detecting portion and a result detected at the environment detecting portion when the first image bearing member is operated at a predetermined velocity.

15 Claims, 11 Drawing Sheets

IMAGE FORMING APPARATUS WITH TONER DEGRADATION SUPPRESSION

BACKGROUND OF THE INVENTION

1. Field of the Invention

The present invention relates to an image forming apparatus according to an electrophotographic system having a development device.

2. Description of the Related Art

Generally, in an image forming apparatus according to an electrophotographic system, an image is formed by an image forming process. The image forming process includes a charging process step, an exposure process step, a development process step, a transfer process step, a fixing process step, and a cleaning process step.

In forming images, first, the surface of an electrophotographic photosensitive member (in the following, referred to as a photosensitive member) is uniformly charged. After that, the photosensitive member is exposed according to image information to form an electrostatic latent image. Subsequently, a toner is supplied to the electrostatic latent image, and then the electrostatic latent image is turned into a toner image. The toner image formed on the photosensitive member is then transferred on a recording material such as a paper sheet. The recording material on which the toner image is transferred is heated and pressurized in the fixing process step. Thus, the toner image is fixed on the surface of the recording material. Therefore, forming the image on the recording material is ended. On the other hand, the toner remains on the surface of the photosensitive member after the toner image is transferred. The residual transfer toner is removed in the cleaning process step.

Heretofore, particularly in an image forming apparatus that forms images in chromatic colors among image forming apparatuses according to the electrophotographic system, a two component development system is widely used, in which a nonmagnetic toner (a toner) and a magnetic carrier (a carrier) are mixed and used for a developer. As compared with other presently known development systems, the two component development system has advantages such as the stability of image quality and the durability of the apparatus.

In the image forming apparatus using the two component development system, in the case where an electrostatic latent image formed on a photosensitive drum that is an image bearing member is developed to form a toner image, generally, the image is formed as follows. The surface of the photosensitive drum is first uniformly charged by a charging portion in such a way that the potential of the photosensitive drum is at a white base portion potential Vd. Moreover, a developing bias voltage is applied to a developing sleeve that is a developer bearing member, and the potential of the developing sleeve is made to the same as a direct current component Vdc of the developing bias voltage.

In this application, a potential difference between the white base portion potential Vd and the direct current component Vdc of the developing bias voltage is set to a desired fog removal potential difference Vback. Moreover, an image portion (a developed portion) on the photosensitive drum is exposed by an exposing portion that forms an electrostatic latent image, and the potential of the image portion is made at an attenuated bright portion potential VL. Then, a contrast potential difference Vcont that is a difference between the bright portion potential VL and the direct current component Vdc of the developing bias voltage causes a toner on the developing sleeve to move to the photosensitive drum. As described above, the electrostatic latent image formed on the photosensitive drum is developed as a toner image.

Generally, in such a two component development system, the toner is consumed by forming images, and the toner is replenished accordingly. Thus, forming images is repeated to sequentially replace the toner in the developer.

However, particularly in the image forming apparatus using the two component development system, the following problem arises.

In these years, various types of paper sheets are used for recording materials. For the recording materials, there are many types of recording materials such as inexpensive paper sheets with a low surface smoothness (mainly recycled paper sheets) and paper sheets with a high smoothness such as coated paper sheets. Among these recording materials, particularly in the case of a paper sheet with a low smoothness, the transfer characteristic of a toner is altered along the surface shape of the paper sheet, and transfer irregularity tends to occur.

Generally, a transfer condition (a transfer bias) to a paper sheet is changed according to the setting of a paper sheet type (a plain paper sheet, recycled paper sheet, thick paper sheet, OHT, and so on) selected by a user. However, in the case where a toner is degraded due to long-term use and a temperature rise, it is difficult to keep the transfer characteristic to a paper sheet through long-term use.

The following are situations that a toner tends to be degraded. In the case where images (images with a low image ratio) that use a low amount of a toner are continuously output, the toner is rarely replaced. In this case, time for which a single toner exists in the developing device is prolonged, and the toner is kept circulating for a long time in the developing device.

When the dwell time of the toner is prolonged in the developing device, the toner is repeatedly rubbed and stirred in the developing device for a long time, causing the case where the toner shape becomes irregular and the case where the grain size distribution is unbalanced. Moreover, an additive, which is added to a developer to improve flowability, is sometimes embedded in the toner surface. As a result of these problems, when degradation occurs such as a decrease in the flowability of the developer, an image of a desired image quality might not be obtained.

For a method for solving these problems, in Japanese Patent Laid-Open No. 2006-337699, a unit that calculates the image ratio of an image being formed is provided, in which when it is detected that the calculated image ratio is below a predetermined value, a predetermined amount of a toner is developed in a non-image region to forcedly consume the toner. The amount of a toner consumed is then newly replenished in a developing device. Thus, the degraded toner is replaced by a new toner.

This control is performed to prevent the toner in the developing device from not being replaced in the case where images with a low image ratio are continuously kept output. Thus, reductions in image quality and image density are prevented. Here, particularly in the case of using a paper sheet with a low smoothness such as a recycled paper sheet, it is necessary to replace a larger amount of a toner in order to maintain the transfer characteristic to the paper sheet as compared with the case of using a paper sheet with a high smoothness.

The situations that a toner tends to be degraded will be further described. With the downsizing of an electrophotographic apparatus in these years, the device internal temperature of an image forming apparatus main body tends to rise caused by heat generated from a fuser and an electric circuit board. Thus, in association with the temperature rise in the main body, it is likely to soften a toner in the development device. It is noted that generally, the softening point of a toner is temperatures of about 60 to 80° C.

Moreover, in the case where the user turns off a power supply, the rotation of a cooling fan that cools the inside of the main body is also stopped. The temperature of the development device where the cooling performance is reduced then suddenly rises, and sometimes partially exceeds the softening point of a toner. The toner is softened and degraded, sometimes causing image quality to be considerably reduced under a high temperature environment.

For a method for solving these problems, in Japanese Patent Laid-Open No. 5-257358, even in the case where the power supply of an image forming apparatus main body is turned off, a cooling fan is operated until the temperature of a development device reaches a preset temperature. Such control is performed to prevent a sudden temperature rise in the development device in the case where the power supply of the main body is turned off, and to suppress the degradation of a toner caused by softening the toner in the development device. Thus, the degradation of image quality can be prevented.

Here, particularly in the case of using a paper sheet with a low smoothness such as a recycled paper sheet, it is necessary to reduce the temperature of the development device (the temperature of a toner) as compared with the case of using a paper sheet with a high smoothness in order to maintain the transfer characteristic to a paper sheet.

However, in the case of Japanese Patent Laid-Open No. 2006-337699, a toner replacement amount is constant regardless of paper sheet types. Thus, in the case where the toner replacement amount is set larger as matched with a paper sheet with a low smoothness, a toner is wasted when using a paper sheet with a high smoothness. On the contrary, when the toner replacement amount is set smaller as matched with a paper sheet with a high smoothness, it is difficult to maintain the transfer characteristic of a toner to a paper sheet in the case of using a paper sheet with a low smoothness.

Moreover, in the case of Japanese Patent Laid-Open No. 5-257358, the temperature threshold of the development device at which it is determined whether the cooling fan is operated is constant regardless of paper sheet types. Thus, when the temperature at which the cooling fan is operated is set lower as matched with a paper sheet with a low smoothness, the fan is excessively operated in the case of using a paper sheet with a high smoothness. This excessive operation causes a harmful effect such as a reduction in the lifetime of a fan motor and noise caused by operating the fan. On the contrary, when the temperature at which the cooling fan is operated is set higher as matched with a paper sheet with a high smoothness, it is difficult to maintain the transfer characteristic of a toner to a paper sheet in the case of using a paper sheet with a low smoothness.

SUMMARY OF THE INVENTION

Therefore, it is desirable to efficiently and appropriately manage the state of a developer while stably maintaining the transfer characteristic of a toner to a recording material.

According to the present invention, there is provided an image forming apparatus including: an image bearing member; a developing device configured to supply a developer to an electrostatic latent image formed on the image bearing member to form a toner image; an input portion configured to receive information about a type of a recording material on which the toner image is transferred; a toner degradation suppressing portion configured to perform an operation to suppress degradation of a toner accommodated in the developing device; and a controller configured to control the operation of the toner degradation suppressing portion from information input from the input portion so that an effect of suppressing degradation of a toner is larger when information is input that a type of a recording material to be used has a low smoothness than when information is input that a type of a recording material to be used has a high smoothness.

Further features of the present invention will become apparent from the following description of exemplary embodiments with reference to the attached drawings.

DESCRIPTION OF THE EMBODIMENTS

In the following, embodiments of the present invention will be described with reference to the drawings. It is noted that the configurations of the embodiments are exemplifications, and the technical scope of the present invention is not necessarily limited to the configurations of the embodiments.

First Embodiment

Configuration of an Image Forming Apparatus

Figure 1:
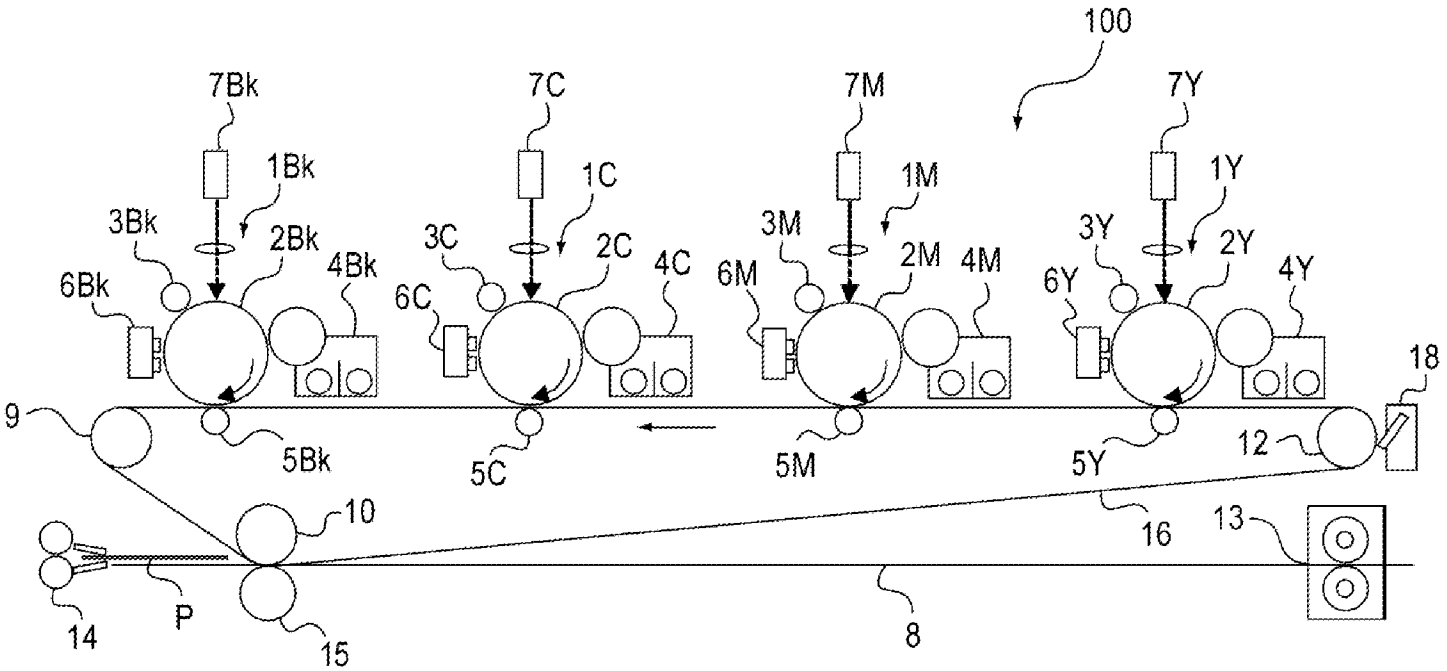
FIG. 1 is a schematic block diagram of an image forming apparatus according to a first embodiment.

The overall configuration and operation of an image forming apparatus according to this embodiment will be described. FIG. 1 is a schematic block diagram of an image forming apparatus according to a first embodiment.

An image forming apparatus 100 is a full color printer according to the electrophotographic system. The image forming apparatus 100 includes four image forming portions 1 (1Y, 1M, 1C, and 1Bk) corresponding to four colors, yellow Y, magenta M, cyan C, and black Bk.

In this embodiment, these four image forming portions 1Y, 1M, 1C, and 1Bk included in the image forming apparatus 100 have substantially the same configuration except that developing colors are different from each other. Therefore, in the following, suffixes Y, M, C, and Bk added in reference numerals and signs for indicating that components belong to any image forming portions are omitted unless otherwise distinguished particularly, and the description will be given collectively.

The image forming apparatus 100 receives an image signal from a host device such as an original reader connected to an image forming apparatus main body and a personal computer connected to the image forming apparatus main body for allowing communications. The image forming apparatus 100 forms a four full color image on a recording material according to this image signal. For the recording material, there are a recording paper sheet, a plastic film, cloth, and so on.

An image forming portion 1 includes photosensitive drums 2 (2Y, 2M, 2C, and 2Bk) that are image bearing members. The image forming apparatus 100 is configured in which a toner image formed on the photosensitive drum 2 is primarily transferred to an intermediate transfer belt 16, and secondarily transferred on a recording material P conveyed by a recording material bearing member 8. In the following, description will be given in detail.

The photosensitive drum 2 is a cylindrical photosensitive member, and rotated and driven in the direction of an arrow in the drawing. A charging roller 3 (a charging member), a development device 4 (a developing portion), a primary transfer roller 5 (a primary transfer member), a secondary transfer roller 15 (a secondary transfer member), and a cleaning device 6 (a cleaning member) for a secondary transfer counter roller 10 are disposed around the photosensitive drum 2. Moreover, a laser scanner 7 (an exposing portion) is disposed above the photosensitive drum 2 in the drawing.

Furthermore, the intermediate transfer belt 16 is disposed as facing all the photosensitive drums 2 of the image forming portion 1. The intermediate transfer belt 16 is stretched by a drive roller 9, the secondary transfer counter roller 10, and a stretch roller 12, and moved around the direction of an arrow in the drawing by the drive of the drive roller 9.

As described above, the toner image formed on the photosensitive drum 2 is primarily transferred on the intermediate transfer belt 16, and subsequently secondarily transferred on the recording material P conveyed by the recording material bearing member 8. After the toner image is secondarily transferred from the intermediate transfer belt 16 to the recording material P, the toner image is heat-fixed on the recording material P by a fuser 13.

(Image Forming Operation)

The operation of the image forming apparatus will be described as an example is taken in which a full four color image is formed with reference to the configuration described above.

First, when the image forming operation is started, the surface of the rotating photosensitive drum 2 is uniformly charged by the charging roller 3. In this charging, a charging bias is applied to the charging roller 3 by a charging bias power supply.

Subsequently, the photosensitive drum 2 is exposed by a laser beam corresponding to an image signal sent from the laser scanner 7. Thus, an electrostatic latent image is formed on the photosensitive drum 2 according to the image signal. The electrostatic latent image on the photosensitive drum 2 is visualized with a toner accommodated in the development device 4 to be a visible image (a toner image). In this embodiment, a reversal development system is used in which the toner is attached to the potential of a bright portion exposed by the laser beam.

The toner image on the photosensitive drum 2 is primarily transferred on the intermediate transfer belt 16. After primary transfer, the toner (residual transfer toner) that remains on the surface of the photosensitive drum 2 is removed by the cleaning device 6. This operation is sequentially performed at the image forming portions 1 corresponding to yellow, magenta, cyan, and black to overlay four color toner images with each other on the intermediate transfer belt 16.

After this overlaying, a recording material P accommodated in a recording material accommodating cassette is conveyed by a feed roller 14 and the recording material bearing member 8 as matched with the timing of forming the toner images. A secondary transfer bias is then applied to the secondary transfer roller 15, and the four color toner images on the intermediate transfer belt 16 are secondarily collectively transferred to the recording material P borne on the recording material bearing member 8.

Subsequently, the recording material P is removed from the recording material bearing member 8, and conveyed to the fuser 13. The recording material P is heated and pressurized at the fuser 13. Thus, the toner on the recording material P is molten and mixed, and a full color permanent image is fixed to the recording material P. After this fixing, the recording material P is ejected out of the apparatus.

Moreover, the toner that is not fully transferred at the secondary transfer portions and remains on the intermediate transfer belt 16 is removed by an intermediate transfer belt cleaner 18. Thus, a series of the image forming operation is ended. It is noted that it is also possible to use only a desired image forming portion to form a monochrome image of a desired color or an image of a plurality of colors.

(Development Device)

Figure 2:
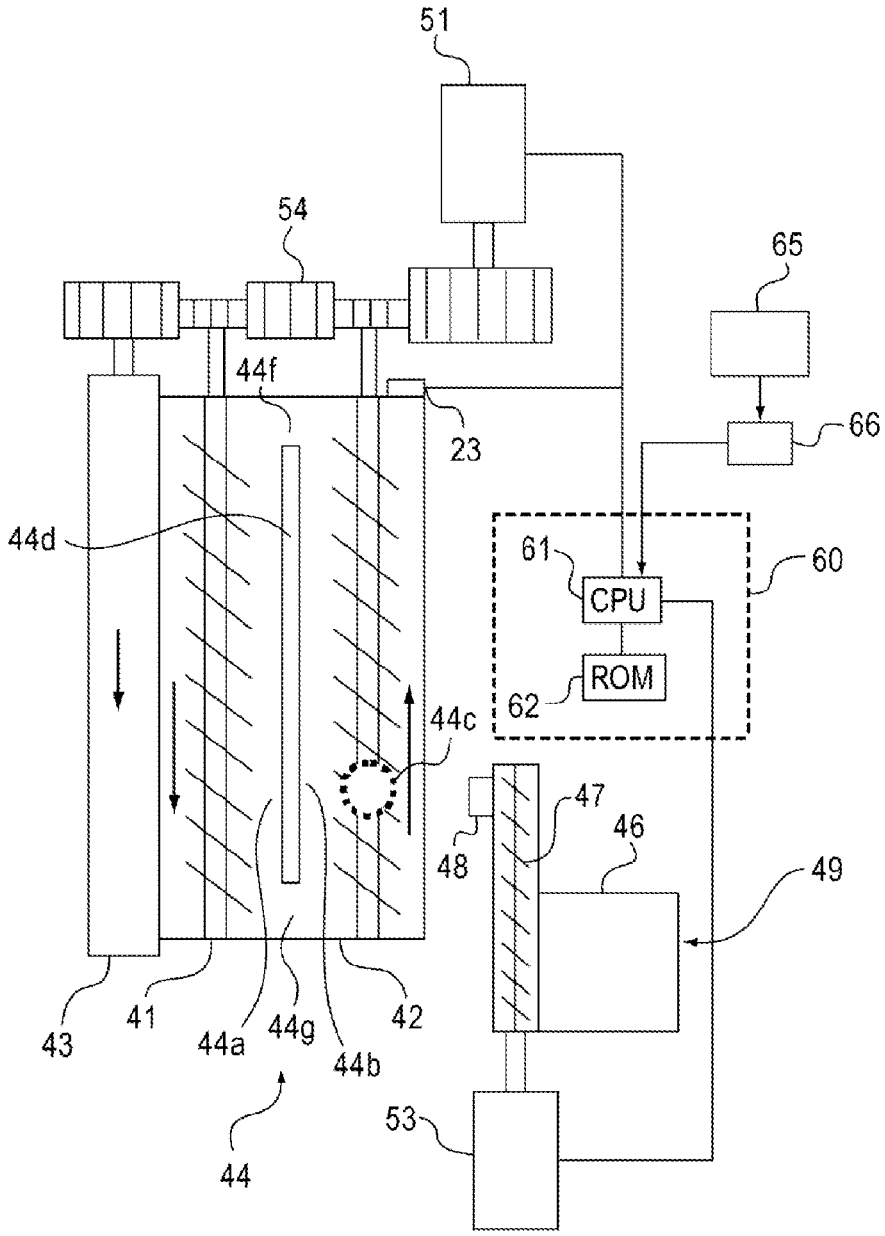
FIG. 2 is an illustration illustrative of a development device and a toner replenishing portion according to the first embodiment.

Next, the development device 4 will be described with reference to FIG. 2. FIG. 2 is an illustration illustrative of the development device and a toner replenishing portion according to the first embodiment. In this embodiment, the configurations of the yellow, magenta, cyan, and black development devices are all the same.

The development device 4 includes a developing container 44 that contains a two-component developer having a nonmagnetic toner particle (a toner) and a magnetic carrier particle (a carrier) as principal components.

The toner is added with a coloring resin particle including a binding resin, a coloring agent, and other additives as necessary, and an additive such as colloidal silica impalpable powder and titanium oxide. The toner is a negatively charged polyester resin manufactured by a polymerization method, and the volume average grain size can range from 5 to 8 μm or less. The volume average grain size of the toner according to this embodiment is 6.2 μm.

The carrier is a metal such as surface-oxidized or unoxidized iron, nickel, cobalt, manganese, chromium, and rare earth, an alloy of these metals, or oxide ferrite can be used, for example. A manufacturing method for these magnetic particles is not limited particularly. Moreover, the weight average grain size of the carrier ranges from 20 to 50 μm, preferably 30 to 40 μm, and the resistivity is $10^7$ Ω·cm or more, preferably $10^8$ Ω·cm or more. For the resistivity of the carrier according to this embodiment, a carrier having a resistivity of $10^8$ Ω·cm was used.

In this embodiment, for a low specific gravity magnetic carrier, such a resin magnetic carrier was used that a phenol binder resin is mixed with a magnetic metal oxide and a nonmagnetic metal oxide at a predetermined ratio by a polymerization method. The volume average grain size is 35 μm, the true density ranges from 3.6 to 3.7 g/cm$^2$, and the magnetization value is 53 A·m$^2$/kg.

In the developing container 44, a first stirring convey screw 41 (a first stirring member) and a second stirring convey screw 42 (a second stirring member) are rotatably disposed as members that stir and convey the developer. Moreover, in the developing container 44, a developing sleeve 43 is rotatably disposed. Here, the first stirring convey screw 41, the second stirring convey screw 42, and the developing sleeve 43 are disposed in parallel with each other.

The inside of the developing container 44 is divided into a first chamber (a developing chamber) 44*a* and a second chamber (a stirring chamber) 44*b* by a barrier 44*d*. The developing chamber 44*a* communicates with the stirring chamber 44*b* at both end portions in the longitudinal direction of the developing container 44. The first stirring convey screw 41 is provided in the developing chamber 44*a*, and the second stirring convey screw 42 is provided in the stirring chamber 44*b*.

A magnet roll (not shown) that is a magnetic field generating portion is fixed and disposed in the developing sleeve 43. The magnet roll has a plurality of magnetic poles in the circumferential direction, in which the developer in the developing container 44 is attracted by magnetic force, the developer is borne on the developing sleeve 43, and a magnetic brush is formed in the developing portion facing the photosensitive drum 2.

The first stirring convey screw 41, the second stirring convey screw 42, and the developing sleeve 43 are rotated and driven by a developing-side drive motor 51. The developing-side drive motor 51 transmits drive to the first stirring convey screw 41 and the second stirring convey screw 42 through a gear train 54, and the first stirring convey screw 41 and the second stirring convey screw 42 are rotated in the same rotation direction.

This rotation conveys the developer in the stirring chamber 44*b* while stirring the developer by the second stirring convey screw 42. The developer is then moved into the developing chamber 44*a* through a communicating hole 44*f* that is a communicating portion. Subsequently, the developer coming in the developing chamber 44*a* is moved while stirring the developer by the first stirring convey screw 41. The developer is moved into the stirring chamber 44*b* through a communicating hole 44*g* that is a communicating portion. As described above, the developer circulates in the developing container 44. Electric charges are then given to the developer in the process of stirring and conveying the developer.

The developing sleeve 43 conveys the developer applied on the surface in a layer with a blade (not shown) by the rotation of the developing sleeve 43 to the developing portion facing the photosensitive drum 2. The developer on the developing sleeve 43 develops magnetic brushes by the magnetic force of the magnet roll at the developing portion. The developer that develops magnetic brushes contacts or approaches the surface of the photosensitive drum 2.

On the other hand, a developing bias having an AC voltage and a DC voltage superposed with each other is applied to the developing sleeve 43 by a developing bias applying power supply (not shown) when the electrostatic latent image on the photosensitive drum 2 reaches the developing portion. In this application, the developing sleeve 43 is rotated and driven by the developing-side drive motor 51, and the toner in the developer is transferred onto the photosensitive drum 2 by the developing bias according to the electrostatic latent image on the surface of the photosensitive drum 2.

As described above, the toner is supplied to the electrostatic latent image on the photosensitive drum 2 from the two-component developer conveyed in the developing portion. Thus, the toner is selectively attached to the image portion of the electrostatic latent image, and the electrostatic latent image is developed as a toner image.

(Configuration of Replenishing a Toner)

Next, a toner replenishing operation as the effect of suppressing the degradation of a toner according to this embodiment will be described. As illustrated in FIG. 2, a toner is replenished from a toner replenishing port 44*c* provided on the upper portion on the upstream end portion side in the direction of conveying the developer in the stirring chamber 44*b*.

When the toner in the two-component developer is consumed in the development operation as described above, the toner density of the developer in the developing container 44 is gradually reduced. In order to maintain this toner density, a toner replenishing portion 49 (a toner degradation suppressing portion) replenishes a toner in the developing container 44. The toner replenishing portion 49 includes a toner container 46 that accommodates a toner to be replenished.

The toner contained in the toner container 46 is supplied from a toner outlet port 48. The toner outlet port 48 is joined to the toner replenishing port 44*c* of the developing container 44. Moreover, the toner container 46 is provided with a toner replenishing screw 47 (a toner replenishing member) to convey the toner to the toner outlet port 48. A replenishing-side drive motor 53 rotates and drives the toner replenishing screw 47.

As illustrated in FIG. 2, the rotations of the developing-side drive motor 51 and the replenishing-side drive motor 53 are controlled by a CPU 61 (a controller) of an engine controller 60 included in the image forming apparatus main body. The CPU 61 controls the rotation time of the replenishing-side drive motor 53 to adjust the replenishing amount of the toner in the developing container 44.

The correspondence between the rotation time of the replenishing-side drive motor 53 and the amount of a toner to be replenished into the developing container 44 is measured beforehand by experiment. The result is then stored in the CPU 61 or a ROM 62 connected to the CPU 61 as table data, for example.

A storage device 23 is disposed in the development device 4. In this embodiment, a readable and writable RP-ROM was used for the storage device 23. The storage device 23 is electrically connected to the CPU 61 by setting the development device 4 on the image forming apparatus main body, and can read and write information about image forming processing of the development device 4 from the printer side. Moreover, the image forming apparatus 100 is provided with a control panel 65 through which the user makes manipulations, and "a plain sheet mode" and "a recycled sheet mode", described later, can be selected and operated on the control panel 65. In the case where the user selects any one mode, a select signal is detected by a recording material detecting portion 66, and transmitted to the CPU 61. Here, the recording material detecting portion 66 functions as an input portion that receives a type of a recording material.

Figure 3:
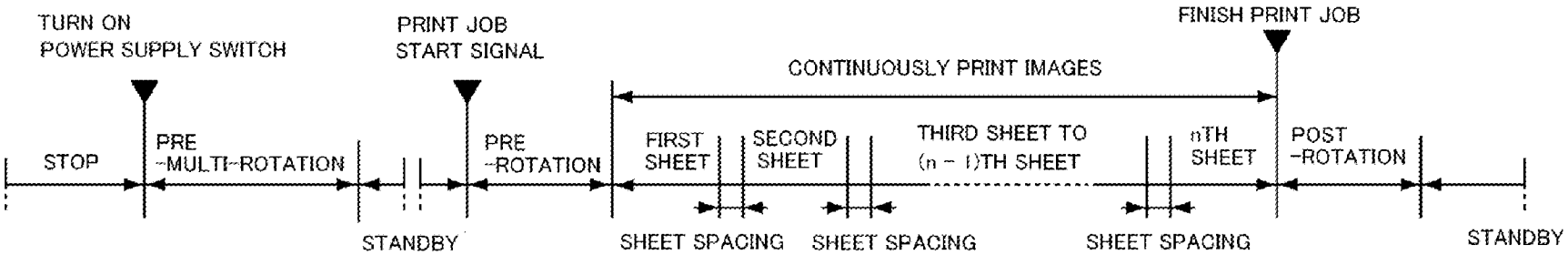
FIG. 3 is a diagram illustrative of the operation process step of the image forming apparatus according to the first embodiment.

Here, the operation process step of the image forming apparatus will be described with reference to FIG. 3. FIG. 3 is a diagram illustrative of the operation process step of the image forming apparatus according to the first embodiment.

(a) Pre-Multi-Rotation Process Step

A starting (activation) operation period (a warming period) for the image forming apparatus is performed. The main power supply switch of the image forming apparatus is turned on to activate the main motor of the image forming apparatus to perform the preparation operation of necessary processing devices.

(b) Pre-Rotation Process Step

The main motor is again driven based on the input of a print job start signal to perform the print job pre-operation of the necessary processing devices. More practically, the print job pre-operation is performed in the following order.

1. The image forming apparatus receives the print job start signal.

2. A formatter expands an image (expansion time is varied depending on the data volume of an image and the processing speed of the formatter).

3. The pre-rotation process step is started.

It is noted that in the case where the print job start signal is input in the pre-multi-rotation process step in (a), the process is then moved to the pre-rotation process step as the subsequent standby in (c) is omitted, after finishing the pre-multi-rotation process step.

(c) Standby

After finishing a predetermined starting operation period, the drive of the main motor is stopped, and the image forming apparatus is held in the standby state until a print job start signal is input.

(d) Performing Print Job

When a predetermined pre-rotation process step is finished, the image forming process is subsequently performed to output a recording material with an image formed thereon.

In the case of a continuous print job, the image forming process is repeated to sequentially output a predetermined number of recording materials with an image formed thereon.

(e) Sheet Spacing Process Step

In the case of the continuous print job, this process step is the process step of providing a spacing between the rear end of a recording material P and the tip end of a subsequent recording material P, and this process step is a period in a state in which no sheet is passed in transfer portions and the fuser 13.

(f) Post-Rotation Process Step

In the case where a print job is made for only a single recording material, after outputting the recording material with an image formed thereon, the main motor is continuously driven for a predetermined time. Thus, this is a period to perform the operation after the print job for the necessary processing devices. Other than after outputting the recording material P, in the case of the continuous print job, the components are similarly driven after outputting the last recording material with an image formed thereon in the continuous print job.

(g) Standby

After finishing a predetermined post-rotation process step, the drive of the main motor is stopped, and the image forming apparatus is held in a standby state until a subsequent print job start signal is input.

In the description above, the time to form an image is the time when performing the print job in (d), and the time to form no image is the time when performing the pre-multi-rotation process step in (a), the pre-rotation process step in (b), the sheet spacing process step in (e), and the post-rotation process step in (f).

The time to form no image is the time to perform at least one of the pre-multi-rotation process step, the pre-rotation process step, the sheet spacing process step, and the post-rotation process step, and at least a predetermined time in the process step.

The image forming speed (the convey speed of the photosensitive drum 2 and the recording material P, in the following, referred to as process speed) in this embodiment is 300 mm/sec, and the rotation speed of the developing sleeve 43 is 400 mm/sec.

The image forming apparatus according to this embodiment adopts a system (a video count system) in which the toner consumption amount can be predicted from the video count number of the image density of an image information signal read by a CCD. In other words, the level of the output signal of an image signal processing circuit is counted for every pixel, and the counted number is added by the pixels of the original paper sheet size to determine a video count number TV per original. For example, the maximum video count number per A4 sheet is 400 dpi, and 3884×106 in 256-level gray scale. The average image ratio is calculated from the addition of the video count number and the number of copies.

(Toner Replacement Operation)

In the following, a toner replacement operation will be described here. In the case where the toner consumption amount is small, the toner in the development device 4 is repeatedly stirred and rubbed again and again in the development device 4 without replacing the toner. Thus, the shape is deformed, or the additive is embedded in the surface to reduce flowability.

First, the secondary transfer characteristic of a toner will be described in the case where the smoothness of a recording material is different with reference to FIG. 4.

Figure 4A:
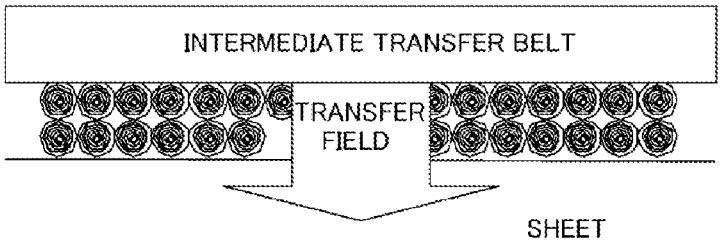
FIG. 4A is a diagram illustrative of a difference of a secondary transfer characteristic between types of recording materials with different smoothness according to the first embodiment.
Figure 4B:
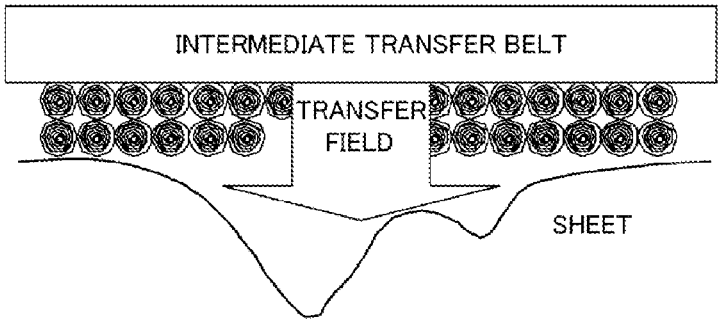
FIG. 4B is a diagram illustrative of a difference of a secondary transfer characteristic between types of recording materials with different smoothness according to the first embodiment.

FIGS. 4A and 4B are diagrams illustrative of the difference of the secondary transfer characteristic between recording materials with different types of smoothness in the first embodiment. FIGS. 4A and 4B illustrate the relationship between the potentials of the image portion and the non-image portion of the image bearing member and the bias to be applied to the developer bearing member in this embodiment. In this embodiment, a negative toner is developed with respect to the exposing portion on the photosensitive drum 2 negatively charged to visualize a toner image as described above. FIGS. 4A and 4B schematically illustrate the potentials of the image portion and the non-image portion on the photosensitive drum and the absolute value of the DC value of the developing bias applied to the developer bearing member.

In transferring a toner on the intermediate transfer belt 16 to the recording material P, a voltage is applied to the secondary transfer roller 15 to form an electric field, and then the toner is transferred to the recording material P. Here, as illustrated in FIG. 4A, a toner is uniformly transferred to a recording material P with a high smoothness. On the other hand, as illustrated in FIG. 4B, in the case of a recording material P with a low smoothness, it is difficult to uniformly transfer a toner because a minute gap occurs between the intermediate transfer belt 16 and the surface of the recording material P. As described above, particularly in the case of continuously forming images at a low image ratio, or in the case where a toner is degraded due to a temperature rise, a reduction in transfer efficiency is noticeable when a low recording material P with a low smoothness is used.

Therefore, the image forming apparatus 100 according to this embodiment has "the plain sheet mode" where a plain paper sheet is used to from an image and "the recycled sheet mode" where a recording material P with a low smoothness is used to form an image. The user can select any mode on the control panel 65 of the image forming apparatus 100. When the user selects any mode on the control panel 65, a mode select signal is detected at the recording material detecting portion 66, and the select signal is transmitted to the CPU 61.

Moreover, a voltage to be applied to the secondary transfer roller 15 is changed according to the mode. In this embodiment, in the case of selecting "the plain sheet mode", a voltage of +700 V is applied. On the other hand, in the case of selecting "the recycled sheet mode", a voltage of +800 V is applied to the secondary transfer roller 15.

Figure 5:
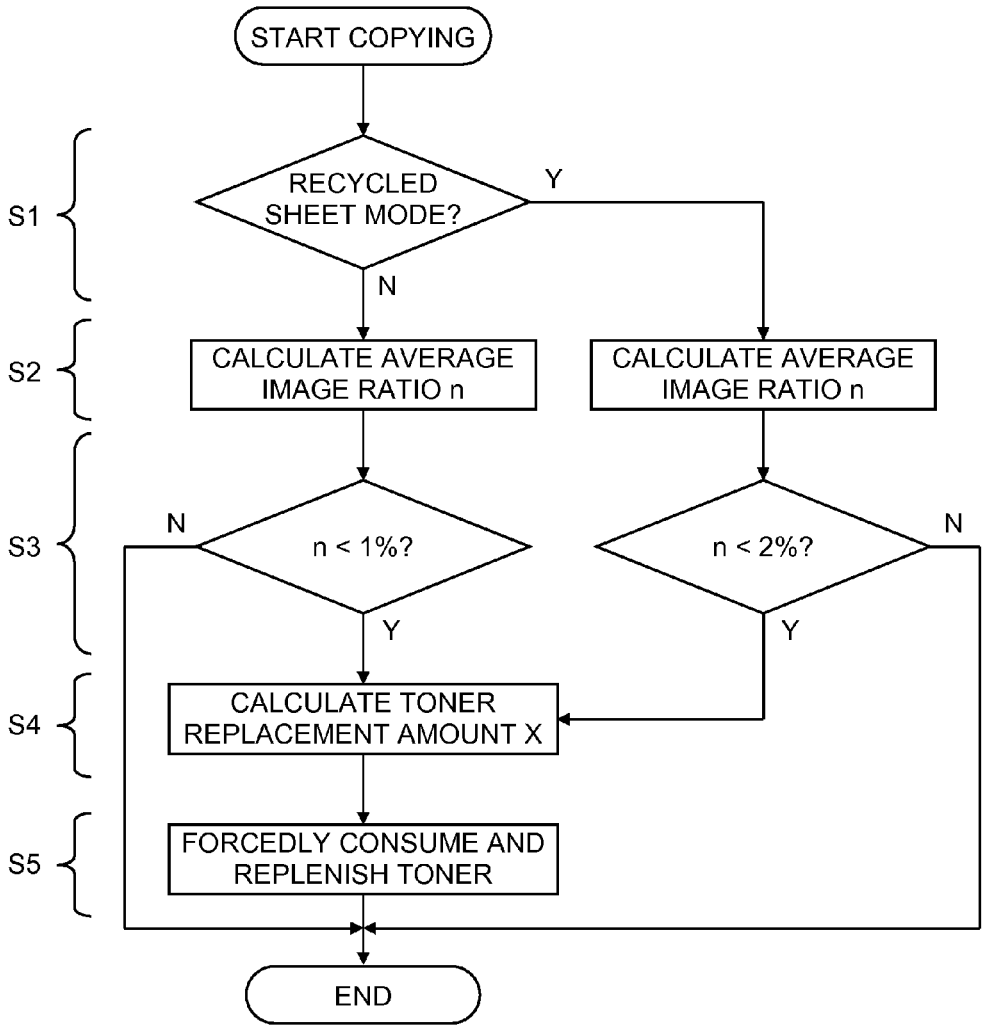
FIG. 5 is a flowchart of the first embodiment.

In this embodiment, in the case of continuously forming images at a low image ratio, the developing device that is the toner degradation suppressing portion is driven to forcedly consume a toner. An amount of a fresh toner corresponding to the consumed amount is then replenished from the toner replenishing portion 49 that is the toner degradation suppressing portion. Thus, the toner is forcedly replaced, and the degradation of image quality is prevented while preventing the degradation of the toner. The flow of this control will be described with reference to a flowchart in FIG. 5. FIG. 5 is a flowchart of the first embodiment.

As illustrated in FIG. 5, when the image forming operation is started, first, information about any one of "the plain sheet mode" and "the recycled sheet mode" is taken in the CPU 61 (S1).

Subsequently, the data of an image input in the CPU 61 is read, and the CPU 61 calculates the image ratio of the image from video count data. The calculated data is then stored in the ROM 62.

The ROM 62 has a sequential record of image ratios for 100 sheets in the past including the image. The CPU 61 reads the data of the image ratios for 100 sheets in the past from the ROM 62. An average image ratio n (%) of 100 sheets in the past is calculated based on the data (S2).

Here, in the case where an image is formed in "the plain sheet mode", it is determined whether the calculated average image ratio is below a predetermined value (1% in the case of this embodiment) (S3). In the case where the calculated average image ratio is below a predetermined value, a toner replacement amount X (mg) is calculated (S4), and a predetermined amount of a toner is forcedly consumed and replenished (S5).

In this embodiment, in order to consume a toner at an average image ratio of 1%, a toner image is formed in a non-image region. More specifically, an electrostatic latent image is formed in the non-image region in the entire region of the photosensitive drum 2 in the axial direction where a laser beam irradiation value is a maximum emission light quantity FFH, and the electrostatic latent image is developed. Namely, a toner is consumed in the non-image region in a predetermined length of the photosensitive drum 2 in the rotation direction, and the toner consumption amount is adjusted.

Figure 6:
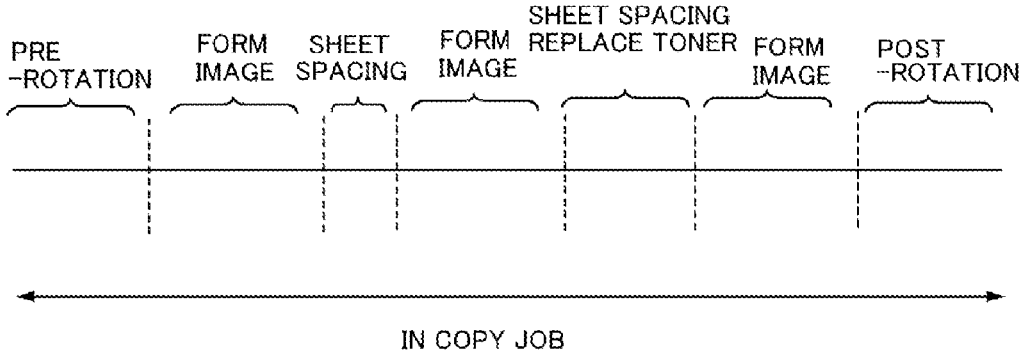
FIG. 6 is a diagram illustrative of timing to perform a toner replacement operation according to the first embodiment.

It is noted that the non-image region in this embodiment is a portion between image forming regions as similar to a sheet spacing portion as illustrated in FIG. 6. FIG. 6 is a diagram illustrative of timing to perform the toner replacement operation according to the first embodiment.

On the other hand, in the case where an image is formed in "the recycled sheet mode", it is determined whether the calculated average image ratio is below a predetermined value (2% in the case of this embodiment) (S3). In the case where the calculated average image ratio is below a predetermined value, the toner replacement amount X (mg) is calculated (S4), and a predetermined amount of a toner is forcedly consumed and replenished (S5).

In this embodiment, an electrostatic latent image is formed in the non-image region in the entire region of the photosensitive drum 2 in the axial direction so as to consume an amount of a toner corresponding to an average image ratio of 2% where a laser beam irradiation value is a maximum emission light quantity FFH, and the electrostatic latent image is developed. Namely, the toner consumption amount is adjusted in the length of the photosensitive drum in the rotation direction.

(Method for Calculating the Toner Replacement Amount)

A method for calculating the toner replacement amount X (mg) is as follows. The toner replacement amount X is expressed as $$X\,(\text{mg})=400\,(\text{mg})\times\{(m\%-n\%)/100\}\times 100\text{ sheets},$$

where the toner consumption amount of one solid A4 sheet (the image duty of 100%) is 400 mg.

Here, X is the toner replacement amount, m is the threshold of the average image ratio where a toner is discharged in the plain sheet mode and the recycled sheet mode, and n is the average image ratio. It is noted that for the value m of the threshold in this embodiment, the value m is 1% in the plain sheet mode and 2% in the recycled sheet mode.

The toner image developed on the photosensitive drum 2 for replacing a toner is not transferred on the recording material P, and all removed by the cleaning device 6. Moreover, a toner is replenished from the toner replenishing screw 47 into the development device 4 while consuming a toner or after consuming a toner. Here, the toner consumption amount and the toner replenishing amount are the same amount. Therefore, a toner in the development device 4 is replaced, and the flowability and charging amount of a toner are made appropriate.

As described above, in this embodiment, the toner discharge amount (the toner replacement amount) when images at a low image ratio are continuously formed is changed according to a type of a selected recording material, and the effect of suppressing the degradation of a toner is changed. As a result, it is possible to control the degree of the degradation of a toner according to a type of a selected recording material, and it is possible to suppress an excessive toner replacement while always maintaining a stable transfer characteristic of a toner.

In this embodiment, the threshold of the operation to discharge the toner from the developing device is changed, and the frequency of performing discharge is varied according to a type of a recording material. For another method, the discharge frequency may be fixed to change the discharge amount (discharge time) according to a type of a recording material. In this case, the discharge amount or discharge time may be changed in such a way that the discharge amount per discharge operation is increased in the recycled sheet mode more than in the plain sheet mode.

It is noted that in this embodiment, the average image ratio is calculated from the addition of the video count number and the number of copies. However, this embodiment is not limited thereto. For example, such a configuration may be possible in which the time for the image forming operation and a toner consumption amount in the development device 4 during the image forming operation are measured and the average image ratio is calculated from the toner consumption amount per unit time.

Second Embodiment

Next, a second embodiment will be described. It is noted that the basic configuration and operation of an image forming apparatus according to this embodiment are the same as in the first embodiment. Therefore, components having the same function and configuration or a corresponding function and configuration are designated the same reference numerals and signs for omitting the detailed description, and characteristic points in this embodiment will be described below.

Figure 7:
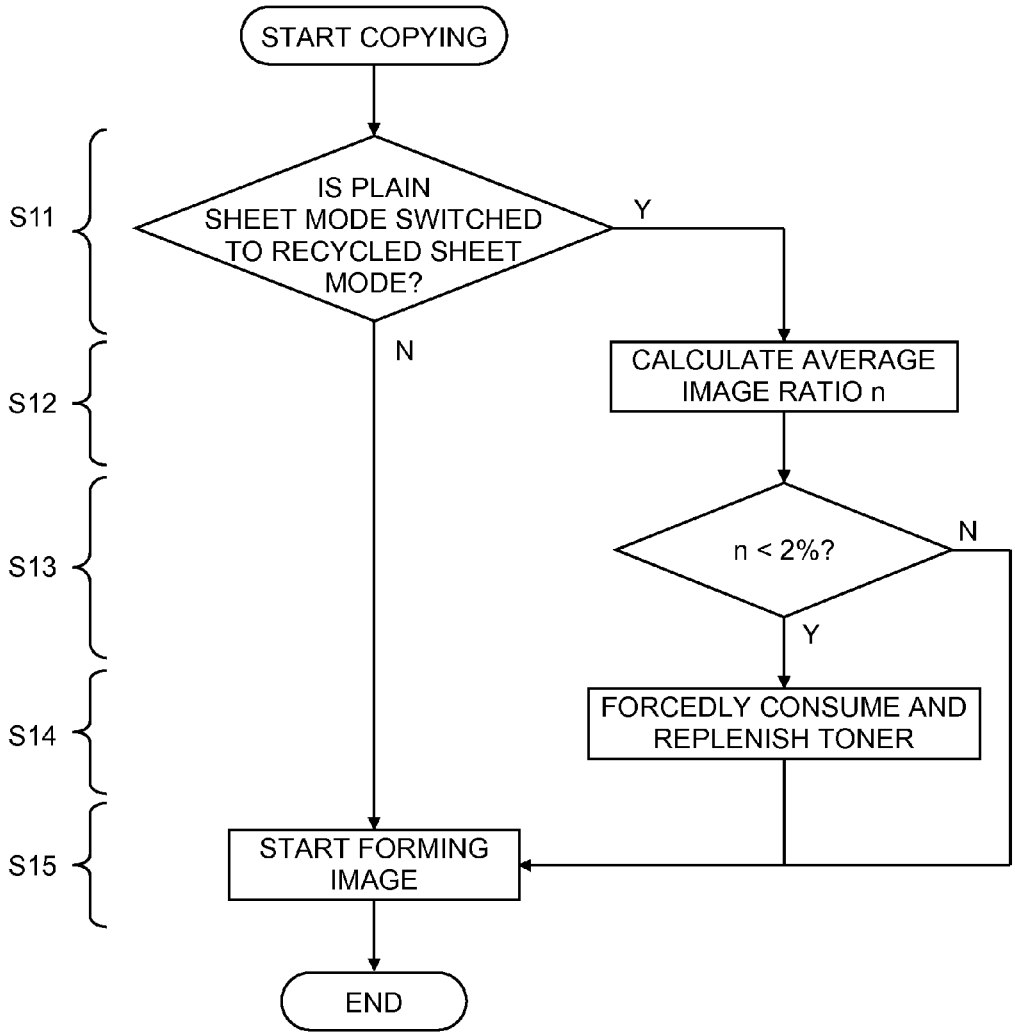
FIG. 7 is a flowchart of a second embodiment.

FIG. 7 is a flowchart of the second embodiment. In this embodiment, when the mode is switched from "the plain sheet mode" to "the recycled sheet mode", a toner in a development device is replaced by a predetermined amount beforehand in pre-rotation before forming an image in "the recycled sheet mode". In the following, the detail will be described.

In the first embodiment, in the case where "the plain sheet mode" is selected, a toner in the development device is replaced when the average image ratio is 1% or less. On the other hand, in the case where "the recycled sheet mode" is selected, a toner in the development device is replaced when the average image ratio is 2% or less.

Here, for example, in the case where images at an average image ratio of 1.5% are continuously formed in "the plain sheet mode" and an image is subsequently formed in "the recycled sheet mode", it is likely to cause faulty secondary transfer. In other words, the average image ratio is 1.5% in "the plain sheet mode" and the average image ratio in "the subsequent recycled sheet mode" is determined whether the average image ratio is one, so that the value might exceed the average image ratio in "the recycled sheet mode".

Therefore, in this embodiment, when the mode is switched from "the plain sheet mode" to "the recycled sheet mode", a toner in the development device is replaced by a predetermined amount beforehand in pre-rotation in "the recycled sheet mode". More specifically, the operation will be described with reference to a flow in FIG. 7.

When the image forming operation is started, first, information whether the mode is switched from "the plain sheet mode" to "the recycled sheet mode" is taken in the CPU 61 (S11). Here, in the case where the mode is switched from "the plain sheet mode" to "the recycled sheet mode", the CPU 61 calculates the average image ratio n (%) in "the plain sheet mode" immediately before (S12).

Then, it is determined whether the calculated average image ratio n is below a predetermined value (2% in the case of this embodiment) (S13). Here, in the case where the average image ratio n is below 2%, a toner of 1.6 g (corresponding to four solid A4 sheets) is consumed. As described above, a toner is forcedly consumed and replenished (S14). After finishing the process steps above, general image formation is started (S15). Moreover, in the case where the mode is not switched from "the plain sheet mode" to "the recycled sheet mode", the control described above (S12 to S14) is not performed, and general image formation is performed (S15).

For a method for consuming a toner, as similar in the first embodiment, an electrostatic latent image is formed in the entire region of a photosensitive drum 2 in the axial direction in pre-rotation where a laser beam irradiation value is a maximum emission light quantity FFH, and the electrostatic latent image is developed.

As described above, in this embodiment, in the case where a copy job (a mixed job) with different types of recording materials occurs, a toner in a development device is replaced by a predetermined amount beforehand according to a type of a recording material in pre-rotation. In the case of a recording material with a low smoothness, the frequency of performing the toner replacement operation is increased more than in the case of a recording material with a high smoothness. Thus, it is possible to control the degree of the degradation of a toner according to a type of a selected recording material, and it is possible to suppress an excessive toner replacement while always maintaining a stable transfer characteristic of a toner.

Third Embodiment

Next, a third embodiment will be described. It is noted that the basic configuration and operation of an image forming apparatus according to this embodiment are the same as in the foregoing embodiments. Therefore, components having the same function and configuration or a corresponding function and configuration are designated the same reference numerals and signs for omitting the detailed description, and characteristic points in this embodiment will be described below.

In this embodiment, a cooling fan 21 (a cooling portion) that cools a development device is used for a toner degradation suppressing portion. In the case of selecting "the recycled sheet mode" in the first and second embodiments, cooling is performed by a cooling fan in forming an imaged for the effect of suppressing the degradation of a toner. In the following, the detail will be described.

Generally, in the case of continuously forming images, the temperature in the main body of an image forming apparatus 100 rises due to the influence of a temperature rise mainly in a fuser 13 and an electric circuit board. In association with the temperature rise in the image forming apparatus 100, the temperature of a developer in a developing container is also increased. As a result, particularly in the case of using a paper sheet with a low smoothness, it is likely to cause faulty secondary transfer due to the degradation of a toner.

Figure 8:
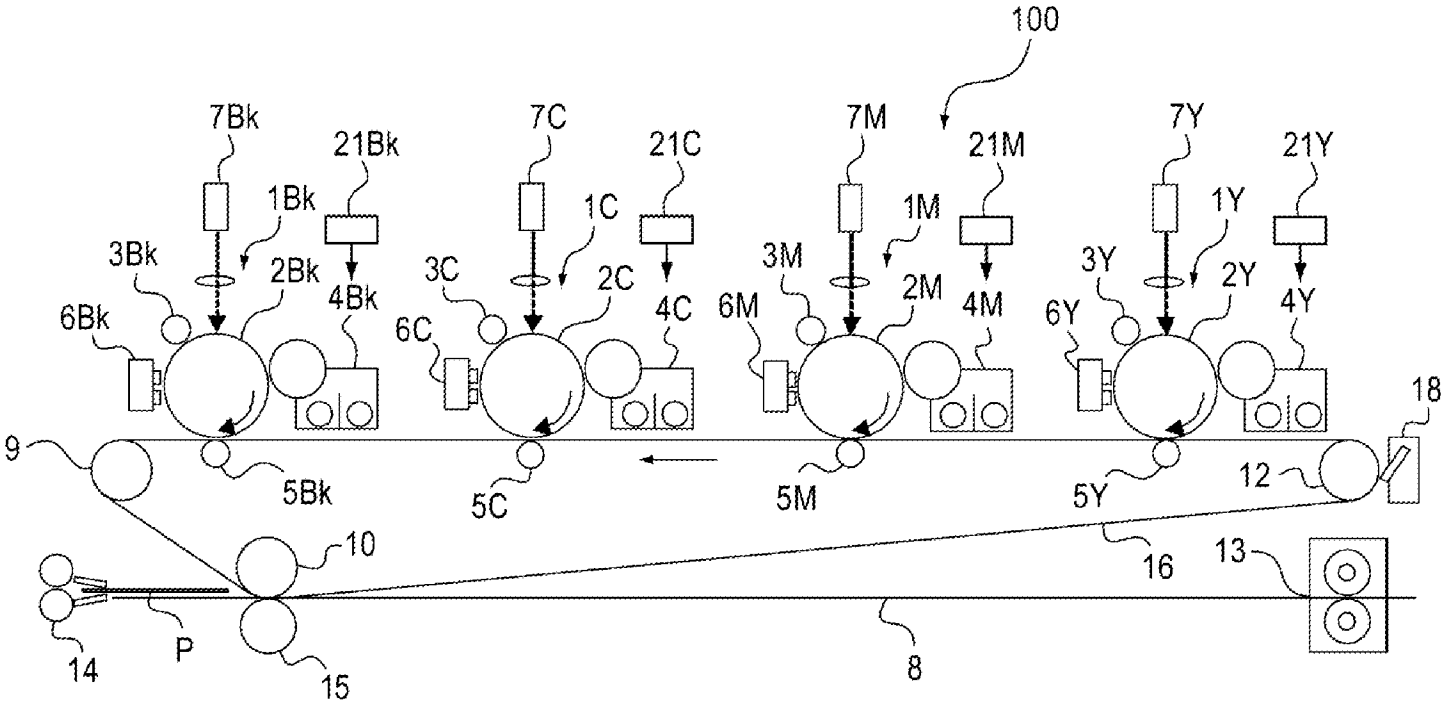
FIG. 8 is a schematic block diagram of an image forming apparatus according to a third embodiment.

FIG. 8 is a schematic block diagram of the image forming apparatus according to the third embodiment. As illustrated in FIG. 8, in this embodiment, cooling fans 21 (21Y, 21M, 21C, and 21Bk) are provided near yellow, magenta, cyan, and black development devices, respectively.

Figure 9:
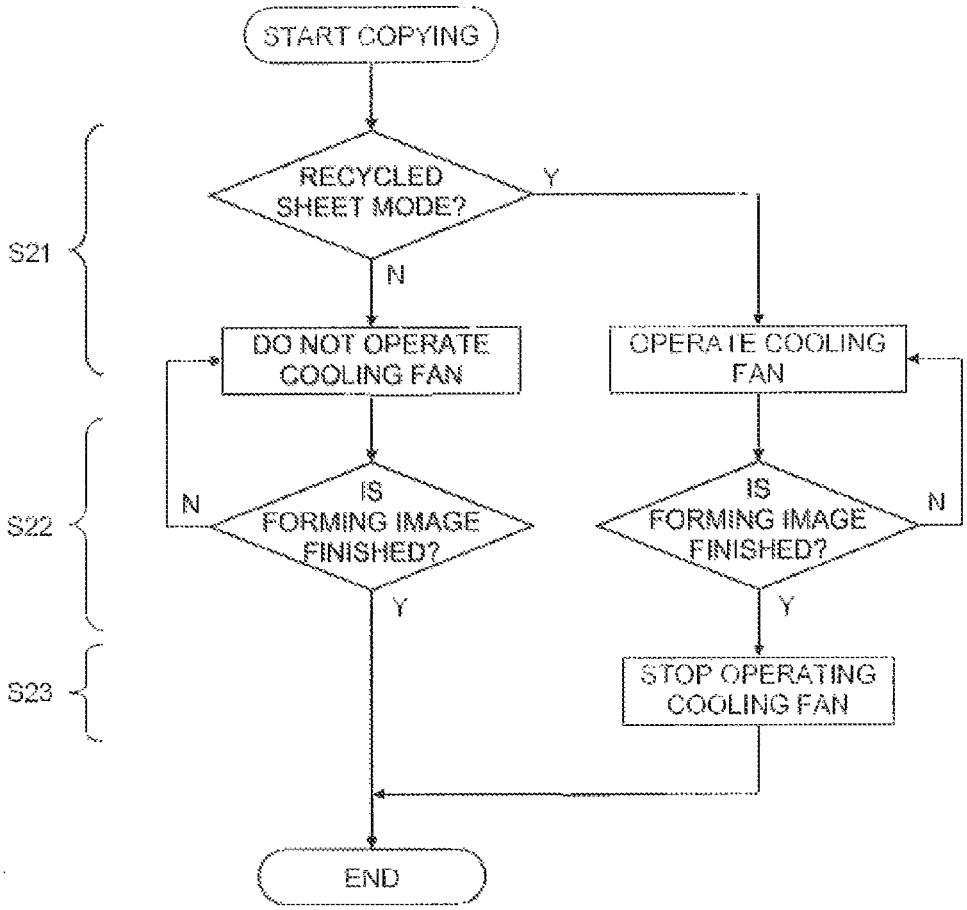
FIG. 9 is a flowchart of the third embodiment.

FIG. 9 is a flowchart of the third embodiment. Control procedures will be described with reference to FIG. 9.

First, when the image forming operation is started, information about any one of "the plain sheet mode" and "the recycled sheet mode" is taken in the CPU (S21).

Here, in the case of selecting "the recycled sheet mode", the image forming operation is started, and the cooling fan 21 is operated simultaneously (S22). Then, the image forming operation is finished, and the operation of the cooling fan 21 is stopped simultaneously (S23).

On the other hand, in the case of selecting "the plain sheet mode", the cooling fan 21 of the development device is not operated.

As described above, in the case of selecting "the recycled sheet mode", the cooling fan 21 is operated to reduce the temperature of the developer in a development device 4. As a result, it is possible to reduce faulty secondary transfer that occurs in the case of using a recycled paper sheet with a low smoothness.

Here, in the case where the cooling fan 21 is operated without consideration of a type of a recording material, the fan is excessively operated when using a recording material with a high smoothness. In this case, it is likely to cause a harmful effect such as a reduction in the lifetime of a fan motor and noise caused by operating the fan.

Thus, in this embodiment, the time to operate the cooling fan 21 is appropriately controlled according to a type of a recording material P detected at a recording material detecting portion 66. More specifically, the cooling fan is stopped in the case of a recording material with a high smoothness, whereas the cooling fan 21 is operated in the case of a recording material with a low smoothness.

It is noted that in this embodiment, the fan is operated only during forming images. However, this embodiment is not limited thereto. For example, such a configuration may be possible in which in the case of selecting the recycled sheet mode, the fan is operated also during standby in forming images.

Moreover, in this embodiment, the cooling fan is operated only in the case of selecting the recycled sheet mode. However, this embodiment is not limited thereto. For example, the similar effect can be obtained even though the effect of suppressing the degradation of a toner is changed, in which the rotation speed of the cooling fan 21 is changed between the plain sheet mode and the recycled sheet mode and the speed of the cooling fan 21 in the recycled sheet mode is set faster than in the plain sheet mode. Furthermore, the effect of suppressing the degradation of a toner may be changed by changing drive time instead of the drive speed of the cooling fan 21. Namely, in the case of a recording material with a low smoothness, the cooling value of the cooling fan 21 may be increased by operating the cooling fan 21 for a longer time after finishing the image forming operation than in the case of a recording material with a high smoothness.

Fourth Embodiment

Next, a fourth embodiment will be described. It is noted that the basic configuration and operation of an image forming apparatus according to this embodiment are the same as in the first embodiment. Therefore, components having the same function and configuration or a corresponding function and configuration are designated the same reference numerals and signs for omitting the detailed description, and characteristic points in this embodiment will be described below.

This embodiment includes a development device temperature sensor 20 (a temperature detecting portion) that detects the device internal temperature of a development device in addition to a cooling fan 21 that cools a development device 4 like the third embodiment. It is determined whether the cooling fan 21 is operated depending on a result detected at the development device temperature sensor 20, and the threshold of the device internal temperature of the development device 4 at which the cooling fan is operated is changed in "the plain sheet mode" and "the recycled sheet mode". In the following, the detail will be described.

Figure 10:
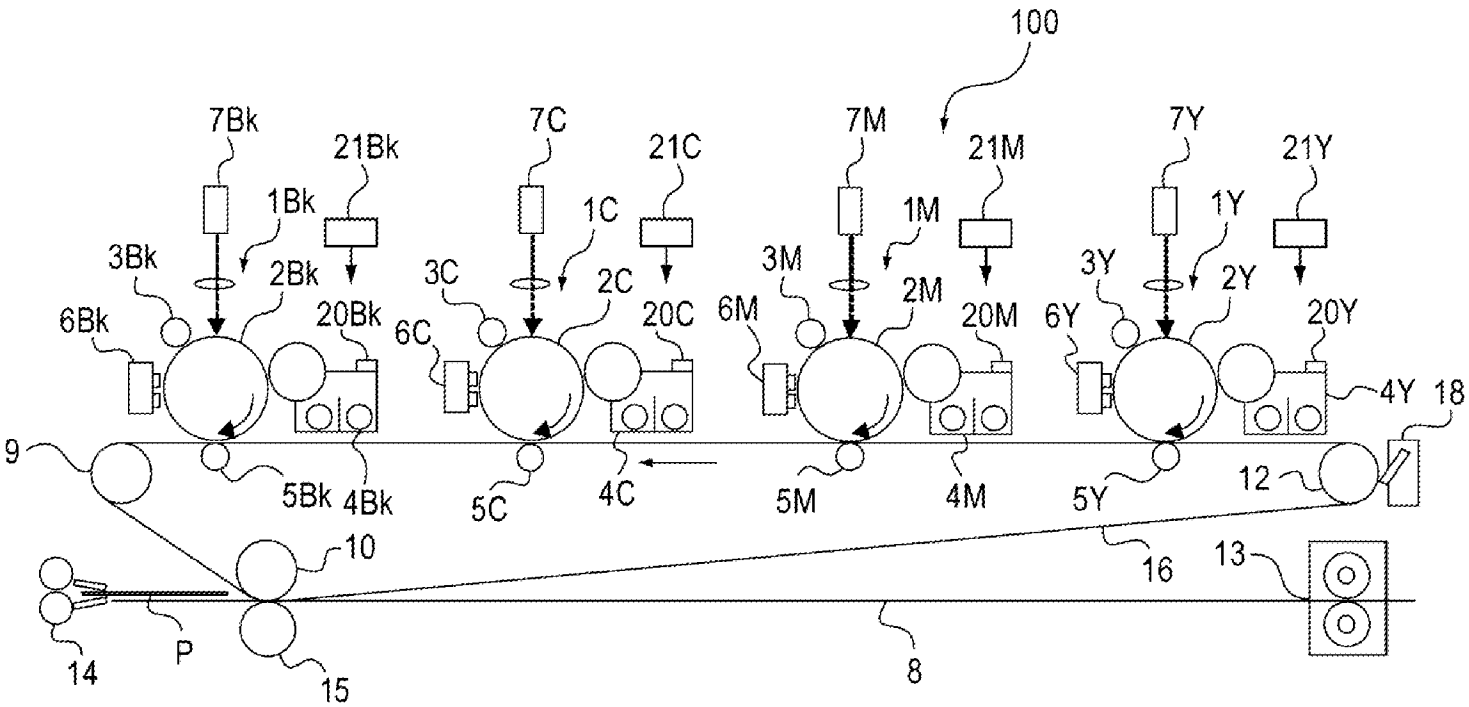
FIG. 10 is a schematic block diagram of an image forming apparatus according to a fourth embodiment.
Figure 11:
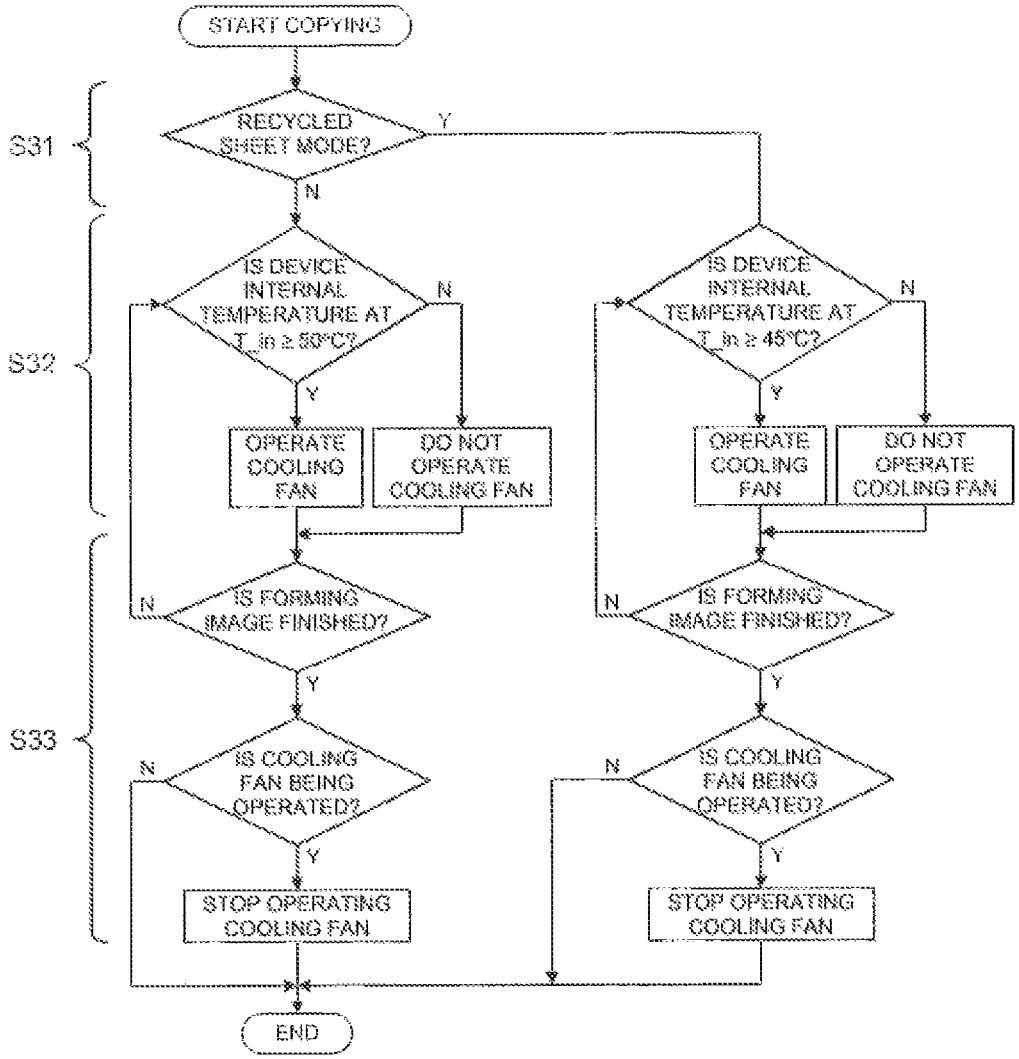
FIG. 11 is a flowchart of the fourth embodiment.

FIG. 10 is a schematic block diagram of an image forming apparatus according to the fourth embodiment. FIG. 11 is a flowchart of the fourth embodiment.

As illustrated in FIG. 10, an image forming apparatus 100 according to this embodiment includes the cooling fan 21 and the development device temperature sensor 20 near yellow, magenta, cyan, and black development devices 4. Control procedures will be described with reference to FIG. 11.

When the image forming operation is started, first, information about any one of "the plain sheet mode" and "the recycled sheet mode" is taken in the CPU (S31). The detected temperature to be a threshold is different depending on the mode taken in the CPU 61. In the following, cases will be separately described.

In the case of selecting "the plain sheet mode", the development device temperature sensor 20 detects a device internal temperature T_in of the development device 4 (S32).

Here, the cooling fan 21 is operated when the detected temperature reaches T_in ≥50° C., in other words, the detected temperature reaches a predetermined threshold or more. On the other hand, in the case where the detected temperature reaches T_in <50° C., the cooling fan 21 is not operated (S32). Namely, in this embodiment, the threshold of the development device temperature sensor 20 at which the cooling fan 21 is operated in "the plain sheet mode" is a temperature of 50° C.

On the other hand, also in the case of selecting "the recycled sheet mode", the development device temperature sensor 20 detects the device internal temperature T_in of the development device 4 (S32).

Here, the cooling fan 21 is operated when the device internal temperature reaches T_in ≥45° C. On the other hand, in the case where the device internal temperature is at T_in <45° C., the cooling fan 21 is not operated (S32). Namely, in this embodiment, the threshold of the development device temperature sensor 20 at which the cooling fan 21 is operated in "the recycled sheet mode" is a temperature of 45° C.

Then, in any of "the plain sheet mode" and "the recycled sheet mode", the operation of the cooling fan 21 is stopped after finishing image formation (S33).

As described above, in this embodiment, the threshold of the device internal temperature at which the cooling fan is operated is changed depending on "the plain sheet mode" and "the recycled sheet mode". Thus, the temperature of a developer in the development device can be reduced particularly in "the recycled sheet mode". As a result, since the influence of faulty transfer due to an increase in the device internal temperature of the development device 4 can be reduced, it is possible to suppress faulty secondary transfer in the case of using a recording material with a low smoothness.

Here, in the case where the cooling fan is operated at a single development device temperature without consideration of a type of a recording material, when the temperature at which the cooling fan is operated is set lower as matched with a recording material with a low smoothness, for example, the fan is excessively operated in the case of using a recording material with a high smoothness. It is likely that this excessive operation causes a harmful effect such as a reduction in the lifetime of a fan motor and noise caused by operating the fan. On the contrary, when the temperature at which the cooling fan is operated is set higher as matched with a recording material with a high smoothness, it is difficult to maintain the transfer characteristic of a toner to a recording material in the case of using a recording material with a low smoothness. Thus, in this embodiment, the cooling fan can be operated in the case where the temperature detected at the temperature detecting portion is a predetermined threshold or more, so that the temperature at which the cooling fan 21 is operated is appropriately controlled.

Other Embodiments

The foregoing embodiments are not necessarily performed independently. The embodiments can be combined and implemented in multiple numbers within a feasible range.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-190757, filed Sep. 1, 2011, which is hereby incorporated by reference herein in their entirety.

What is claimed is:

1. An image forming apparatus comprising:

an image bearing member;

a developing device configured to supply a developer to an electrostatic latent image formed on the image bearing member to form a toner image;

an input portion configured to receive information about a type of a recording material on which the toner image is transferred;

a toner degradation suppressing portion configured to perform an operation to suppress degradation of a toner accommodated in the developing device; and a controller configured to control the operation of the toner degradation suppressing portion from information input from the input portion so that an effect of suppressing degradation of a toner is larger when information is input that a type of a recording material to be used has a low smoothness than when information is input that a type of a recording material to be used has a high smoothness.

2. The image forming apparatus according to claim 1, wherein the toner degradation suppressing portion performs a discharge mode that a toner is discharged from the developing device without performing an image formation on the recording material, and suppresses degradation of a toner.

3. The image forming apparatus according to claim 2, wherein the controller increases a frequency of performing the mode, prolongs time to perform the mode, or increases a discharge amount in performing the mode to increase an effect of suppressing degradation of a toner.

4. The image forming apparatus according to claim 1, wherein the toner degradation suppressing portion includes a cooling portion configured to cool the developing device, and the cooling portion is operated to suppress degradation of a toner.

5. The image forming apparatus according to claim 4, wherein the controller accelerates drive speed of the cooling portion, or prolongs drive time after finishing image formation to increase an effect of suppressing degradation of a toner.

6. The image forming apparatus according to claim 1, wherein the toner degradation suppressing portion performs a mode to discharge a toner from the developing device without performing an image formation on the recording material based on information about an average image ratio, and the controller increases a frequency of performing the mode from information input from the input portion when information is input that a type of a recording material to be used has a low smoothness than when information is input that a type of a recording material to be used has a high smoothness.

7. The image forming apparatus according to claim 1, wherein the toner degradation suppressing portion performs a mode to discharge the toner from the developing device without performing an image formation on the recording material based on information about an average image ratio, and the controller increases a discharge amount in performing the mode from information input from the input portion when information is input that a type of a recording material to be used has a low smoothness than when information is input that a type of a recording material to be used has a high smoothness.

8. The image forming apparatus according to claim 1, wherein the toner degradation suppressing portion includes:

a cooling portion configured to cool the development device; and a temperature detecting portion configured to detect a temperature of the development device; and wherein the cooling portion is operated when the temperature detected at the temperature detecting portion is a predetermined threshold or more; and the threshold is set lower when a recording material with a low smoothness is used than when a recording material with a high smoothness is used.

9. The image forming apparatus according to claim 1, wherein a first mode to form an image on a recording material having a lower smoothness than a predetermined smoothness and a second mode to form an image on a recording material having a higher smoothness than the predetermined smoothness are performed, and when the second mode is switched to the first mode, the controller controls a mode to discharge a toner from the developing device before performing the first mode.

10. An image forming apparatus comprising:

an image bearing member;

a developing device configured to supply a developer to an electrostatic latent image formed on the image bearing member to form a toner image;

an input portion configured to receive information about a type of a recording material on which the toner image is transferred;

a toner degradation suppressing portion configured to perform an operation to suppress degradation of a toner accommodated in the developing device; and a controller configured to control the operation of the toner degradation suppressing portion from information input from the input portion, so that the toner degradation suppressing portion is operated when the information input of a smoothness of a recording material is lower than a predetermined smoothness and so that the toner degradation suppressing portion is stopped when the information input of a smoothness of a recording material is higher than the predetermined smoothness.

11. The image forming apparatus according to claim 10, wherein the toner degradation suppressing portion is a cooling portion that cools the developing device.

12. An image forming apparatus comprising:

an image bearing member;

a developing device configured to supply a developer to an electrostatic latent image formed on the image bearing member to form a toner image;

an input portion configured to receive information about a type of a recording material on which the toner image is transferred;

an executing portion configured to perform a discharge mode to discharge a toner from the developing device without performing an image formation on the recording material; and a controller configured to control the operation of the executing portion based on information input from the input portion.

13. The image forming apparatus according to claim 12, wherein the controller controls the operation of the executing portion from information input from the input portion so that the controller increases a frequency of performing the mode, prolongs time to perform the mode, or increases a discharge amount in performing the mode when the information input of a smoothness of a recording material is lower than a predetermined smoothness more than when the information input of a smoothness of a recording material is higher than a predetermined smoothness.

14. An image forming apparatus comprising:

an image bearing member;

a developing device configured to supply a developer to an electrostatic latent image formed on the image bearing member to form a toner image;

an input portion configured to receive information about a type of a recording material on which the toner image is transferred;

a cooling portion configured to cool the developing device; and a controller configured to control the operation of the cooling portion based on information input from the input portion, wherein the controller prolongs drive time of the cooling portion after finishing image formation or accelerates drive speed of the cooling portion from information input from the input portion when the information input of a smoothness of a recording material is lower than a redetermined smoothness more than when the information input of a smoothness of a recording material is higher than a predetermined smoothness.

15. An image forming apparatus comprising:

an image bearing member;

a developing device configured to supply a developer to an electrostatic latent image formed on the image bearing member to form a toner image;

an input portion configured to receive information about a type of a recording material on which the toner image is transferred;

an executing portion configured to perform a discharge mode to discharge a toner from the developing device without performing an image formation on the recording material; and a controller configured to perform a first mode to form an image on a recording material with a smoothness lower than a predetermined smoothness and a second mode to form an image on a recording material with a smoothness higher than the predetermined smoothness and control the operation of the executing portion so that when the second mode is switched to the first mode, the controller performs the discharge mode before performing the first mode.

* * * * *